US006594833B2

(12) United States Patent
Timoshenko

(10) Patent No.: US 6,594,833 B2
(45) Date of Patent: Jul. 22, 2003

(54) SOFA BED WITH BEDDING COMPARTMENT

(76) Inventor: Vera Timoshenko, 3921 S. 131st E. Ave., Tulsa, OK (US) 74134

( * ) Notice: Subject to any disclaimer, the term of this patent is extended or adjusted under 35 U.S.C. 154(b) by 0 days.

(21) Appl. No.: 10/006,845

(22) Filed: Nov. 5, 2001

(65) Prior Publication Data

US 2003/0084507 A1 May 8, 2003

(51) Int. Cl.[7] ..... A47C 17/22
(52) U.S. Cl. ..... 5/58; 5/52; 5/53.2; 5/59.1
(58) Field of Search ..... 5/52, 53.2, 58, 5/59.1

(56) References Cited

U.S. PATENT DOCUMENTS

| | | | | | |
|---|---|---|---|---|---|
| 100,789 | A | | 3/1870 | Needham | |
| 1,088,258 | A | | 2/1914 | Brezinski | |
| 1,287,486 | A | | 12/1918 | Smith | |
| 1,334,296 | A | | 3/1920 | Freedman | |
| 1,374,961 | A | | 4/1921 | Shumsky | |
| 2,394,969 | A | * | 2/1946 | Robinson | 5/59.1 |
| 2,642,586 | A | * | 6/1953 | Piliero | 5/59.1 |
| 2,673,354 | A | * | 3/1954 | McKay | 5/12.1 |
| 3,069,699 | A | * | 12/1962 | Lande | 5/59.1 |
| 3,110,911 | A | * | 11/1963 | Osborne et al. | 5/59.1 |
| 3,222,691 | A | * | 12/1965 | Osborne | 5/59.1 |
| 3,346,889 | A | * | 10/1967 | Gran | 5/12.1 |
| 4,097,938 | A | | 7/1978 | Pringle | |
| 4,104,747 | A | | 8/1978 | Bell et al. | |
| 5,794,283 | A | | 8/1998 | Vila et al. | |
| 6,050,638 | A | | 4/2000 | West, III | |

* cited by examiner

*Primary Examiner*—Michael F. Trettel
(74) *Attorney, Agent, or Firm*—Michael I. Kroll

(57) ABSTRACT

A sofa bed is provided with a backrest and a bed/seating portion supported by a frame. The frame has a back member with inverted "L" slotted posts, the slots receiving pins on connection member's ends that are pivotally connected to the backrest. Manipulation of the backrest causes the pins to rest in a horizontal slot portion, the connection members then causing the backrest top to be spaced from the frame back member into a forward position in which it is oriented to serve as a seat back for an occupant seated on the bed member. Positioning members brace the backrest bottom against the frame. Further manipulation causes the pins to descend into a vertical slot portion allowing the connection members to pivot such that the backrest is in a substantially flush position against the frame back. Lid members and permanent and removable side portions are provided, with attachable cushioned armrests.

26 Claims, 10 Drawing Sheets

SOFA BED WITH BEDDING COMPARTMENT

BACKGROUND OF THE INVENTION

1. Field of the Invention

The present invention relates generally to convertible furniture and more specifically to convertible sofa beds that in one configuration is a bed, and in another is a sofa.

2. Description of the Prior Art

There are other convertible sofa/bed devices designed to improve the product. Typical of these is U.S. Pat. No. 100,789 issued to Needham on Mar. 15, 1870.

Another patent was issued to Brezinski on Feb. 24, 1914 as U.S. Pat. No. 1,088,258. Yet another U.S. Pat. No. 1,287,486 was issued to Smith on Dec. 10, 1918 and still yet another was issued on Mar. 23, 1920 to Freedman as U.S. Pat. No. 1,334,296.

Another patent was issued to Shumsky on Apr. 19, 1921 as U.S. Pat. No. 1,374,961 Another patent was issued to Pringle on Jul. 4, 1978 as U.S. Pat. No. 4,097,938. Another patent was issued to Bell et al on Aug. 8, 1978 as U.S. Pat. No. 4,104,747. Another patent was issued to Vila et al on Aug. 18, 1998 as U.S. Pat. No. 5,794,283. Another patent was issued to West, III on Apr. 18, 2000 as U.S. Pat. No. 6,050,638.

U.S. Pat. No. 100,789

Inventor: John Needham

Issued: Mar. 15, 1870

This invention relates to a new and useful improvement in a combination sofa and bed, convertible from one to the other with the greatest facility and it consists in the construction, arrangement, and combination of parts as described in the accompanying drawing.

U.S. Pat. No. 1,088,258

Inventor: Joseph Brezinski

Issued: Feb. 24, 1914

The invention relates to improvements to davenport beds and has for its object the production of a device of this character which may be readily and easily converted from a davenport to a bed or vice versa, and which will be of durable and economical construction.

U.S. Pat. No. 1,287,486

Inventor: George A. Smith

Issued: Dec. 10, 1918

The invention relates to davenport beds and has for its object to simplify and improve the construction and operation of such devices with a view to obtain an easily operable davenport bed, of standard size, both as to the bed and settee portions, and wherein the bed clothing will be folded in such a way as to prevent crushing thereof or injury to the mattress.

U.S. Pat. No. 1,334,296

Inventor: Abe Freedman

Issued: Mar. 23, 1920

The invention relates to folding chair or couches and provides a simplified hinge support for a folding bed frame.

An improved arrangement is provided for supporting the couch back structure to be raised vertically and held in upward position while the bed frame is folded up and placed at the rear of the couch frame.

U.S. Pat. No. 1,374,961

Inventor: Solmon Shumsky

Issued: Apr. 19, 1921

This invention relates to convertible furniture of the sofa-bed variety. An article of furniture is provided which, in its initial or folded form, occupies small lateral floor-space and embodies an ornamental sofa or chair-structure having ample space for containing an enclosed mattress and bed-clothing; which may be readily extended into its bed form. Included is an ornamental wooden supporting casing and a folding metal framework of novel construction and comprising several parts correlatively arranged whereby all parts of the structure may be disconnected to admit of cleaning and for purposes of transportation.

U.S. Pat. No. 4,097,938

Inventor: William Pringle

Issued: Jul. 4, 1978

A sofa bed assembly of the type which includes a roller and track arrangement for guiding the movement of the folded bed frame between the storage compartment and the deployed position wherein the roller of the roller assemblies are retractable to provide a quick release connection between the bed frame and the support frame so that the two components can be easily assembled and disassembled.

U.S. Pat. No. 4,104,747

Inventor: Richard Bell et al.

Issued: Aug. 8, 1978

A convertible sofa and bed structure comprising a pair of pivotally interconnected frame members. One of the frame members is utilized as a backrest and the other as a seatrest in the seating or sofa position; and both are moveable to aligned horizontal positions in the bed position. An important feature of the structure resides in the fact that operating linkages are positioned outwardly of a zone beneath the frame member which functions as a seat rest. Thereby, the defined zone will provide an unobstructed storage compartment.

U.S. Pat. No. 5,794,283

Inventor: Jose Vila et al.

Issued: Aug. 18, 1998

A convertible furniture that in one configuration is a bed and in another is a chair, coach or sofa, depending on its dimensions. Telescopically mounted housing members extend out a sufficient amount to define an upper surface over which cushions are positioned to provide a suitable horizontal resting surface. The upper surface is defined with hingedly mounted closure members that cover a storage cavities below. One of the closures at one end includes a frame with one of its sides being slidably mounted to the underside of the closure. The opposite side of the frame is hingedly mounted to the inner wall of the cavity of the largest housing member. The underside of the closure includes a stop member against which the sliding side of the frame engages when it reaches a predetermined position. Two cord or flexible elongated members are attached to the upper end of the frame so that a user by pulling it causes the collapse of the closure back to the horizontal position.

U.S. Pat. No. 6,050,638

Inventor: David T. West III

Issued: Aug. 18, 2000

An article of furniture such as a sofa, couch or love seat having a lockable compartment or enclosure within the seat in which articles and especially firearms may be securely and safely housed and wherein access to the compartment is concealed by a finished cover.

SUMMARY OF THE PRESENT INVENTION

A primary object of the present invention is to provide a convertible bed that can change from a bed configuration to a sofa configuration.

Another object of the present invention is to provide a sofa and bed convertible that is easily transformed from one configuration to the other.

Yet another object of the present invention is to provide a sofa bed convertible having a mattress.

Still yet another object of the present invention is to provide a sofa and bed convertible having a movable backrest that allows the user to transform the device into a sofa configuration and to a bed configuration.

Yet another object of the present invention is to provide a sofa and bed convertible that when in the sofa position contains a storage area behind the backrest portion of the device.

Additional objects of the present invention will appear as the description proceeds.

The present invention overcomes the shortcomings of the prior art by providing a convertible bed that can change from a bed configuration to a sofa configuration.

The sofa bed of the present invention includes strong and durable framing that supports a bed portion that acts as a sofa cushion in the sofa configuration and a mattress in the bed configuration. A backrest is provided that is attached to the frame in a manner such that it may be moved rearwardly and stored substantially flush against the back of the frame. The backrest may be moved back out and positioned so as to form the backrest portion of the sofa, while creating a storage area defined by the backrest, the frame back, a lid member, and side boards at the ends that are either permanently or removably attached to the frame.

A positioning member steadies the backrest for typical loading by seated occupants that lean against it.

Additional side board extensions are provided that are either permanently or removably attached to the first side boards, and extend forward in armrest-like fashion. Padded armrests have slots that allow them to easily be inserted on the side board extensions to form padded armrests, and in the bed configuration, pillows.

The lid member is attached to the backrest connecting structure in one embodiment such that it is stored in vertical fashion next to the backrest when in the bed configuration. In another embodiment, the lid member is hinged to the frame back and is moved up and out of the way when the backrest is moved into the bed configuration, and lowered again to form a shelf when in the bed configuration, or to complete the storage enclosure when in the sofa configuration.

A sofa bed is provided that is selectably convertible between a bed and sofa on a horizontal surface, comprising: a substantially horizontal bed member; a frame, the frame having: a substantially vertical back member; and a supporting structure for the bed member; and a first and second post member attached to the frame back member, each post member having a slot, the slot having a substantially horizontal slot portion and a connected, substantially vertical slot portion; a backrest having a top portion and a bottom portion; a first and second backrest connection member, each connection member having a first end, the first end being pivotally connected to the backrest, each connection member also having a second end, each second end having a pin, the first backrest connection member second end pin being received by the first post member slot, the second backrest connection member second end pin being received by the second post member slot, said pins being movable within and along the horizontal slot portions into the vertical slot portions, such that the backrest top portion is positioned near the frame back member when the second end pins are in the vertical slot portions, and the backrest top portion is positioned at a distance from the frame back member when the second end pins are in the horizontal slot portions; and a backrest bottom portion positioning member, the positioning member positioning the backrest bottom at a distance from the frame back member when the backrest top portion is positioned at a distance from the frame back member.

In another embodiment, the frame back member has a top portion and wherein the sofa bed further comprises a lid member, the lid member extending from the first backrest connection member to the second backrest connection member, the lid member extending from proximate the backrest top portion to proximate the frame back member top portion.

In another embodiment, the lid member is constructed from a fabric.

In another embodiment, the frame back member has a top portion and wherein the sofa bed further comprises a lid member, the lid member being pivotally connected to the frame back member top portion and, in a first position, extending from proximate the backrest top portion to proximate the frame back member top portion, and in a second position, extending upwardly from the frame back member.

In another embodiment, the sofa bed further comprises at least one hand-tightenable tension grip assembly having a pressure member, the at least one grip assembly pressure member being positioned to apply pressure, in response to hand-tightening of the grip assembly, to the connection member, thereby retarding movement of the connection member.

In another embodiment, the sofa bed further comprises at least one side portion attached to the frame.

In another embodiment, the at least one side portion extends to the backrest when the backrest is positioned at a distance from the frame back member, forming an interior walled by the side portion, the backrest and the frame back member.

In another embodiment, the sofa bed further comprises at least one removable side portion, adapted for attachment to the at least one side portion.

In another embodiment, the number of side portions is two.

In another embodiment, the number of removable side portions is two.

In another embodiment, the sofa bed further comprises at least one armrest member, each armrest member having a slot, the slot being adapted to closely receive the removable side portion.

In another embodiment, each of the at least one armrest members is cushioned.

In another embodiment, the at least one side portion is removably attached to the frame.

In another embodiment, the at least one side portion is fastened to one of the frame post members using at least one hook fastener.

In another embodiment, the sofa bed further comprises at least one armrest member, each armrest member being adapted for attachment to the horizontal bed portion supporting structure.

In another embodiment, each of the at least one armrest members is cushioned.

In another embodiment, the number of side portions is two.

In another embodiment, the backrest further comprises at least one framing member and the backrest positioning member further comprises at least one elongated member, the at least one elongated member having a first end and a second end, the at least one first end being attached to the backrest, the at least one second end being attached to the frame such that the backrest bottom portion is braced against movement toward the frame back member.

In another embodiment, the at least one first end attachment to the backrest is detachable and reattachable.

In another embodiment, the at least one second end attachment to the frame is detachable and reattachable.

In another embodiment, the at least one second end is attached to one of the frame post members.

In another embodiment, the at least one second end is attached to the frame back member.

In another embodiment, the backrest is cushioned.

In another embodiment, the frame horizontal bed portion is cushioned.

In another embodiment, the frame horizontal bed portion is removable from the supporting structure.

In another embodiment, the backrest further comprises a left and right framing member, each framing member having a slot, and the backrest positioning member further comprises a left and right elongated member, each elongated member having a first end, each of the first ends having a pin, each of the pins positioned in one of the framing member slots, each elongated member having a second end, each second end being pivotally connected to one of the post members, the framing member slots being of sufficient length to allow the backrest connection member second end pins to move through the length of the vertical slot portions in the post members.

A sofa bed is provided that is selectably convertible between a bed and sofa on a horizontal surface, comprising: a substantially horizontal bed member; a frame, the frame having: a substantially vertical back member; and a supporting structure for the bed member; a backrest having a top portion and a bottom portion; and means for alternately placing the backrest in a substantially vertical position adjacent the frame back member, and placing the backrest in a forward position at a distance from the frame back member, the backrest in the forward position being positioned and braced for supporting the backs of occupants seated on the bed member.

In another embodiment, the backrest further comprises a top portion and the sofa bed further comprises means for covering the space between the top portion of the backrest and the frame back member when the backrest is in the forward position.

In another embodiment, the sofa bed further comprises means for removably attaching two side portions adjacent the backrest when the backrest is in the forward position.

In another embodiment, the sofa bed further comprises means for supporting the arms of an occupant seated on the bed member when the backrest is in the forward position.

A sofa bed is provided that is selectably convertible between a bed and sofa on a horizontal surface, comprising: a substantially horizontal bed member; a frame, the frame having: a substantially vertical back member; and a supporting structure for the bed member; and a first and second post member attached to the frame back member; a backrest having a top portion and a bottom portion; a first and second backrest connection member, each connection member having a first end, the first end being pivotally connected to the backrest, each connection member also having a second end pivotally attached to one of the post members, such that the backrest is movable to a rear position near the frame back member, the backrest being elevated by such movement into a substantially vertical position that is elevated above the bed member, the backrest also being movable to a forward position, such that the backrest top portion is positioned at a distance from the frame back member; and a backrest bottom portion positioning member, the positioning member positioning the backrest bottom at a distance from the frame back member when the backrest is in the forward position.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 7:
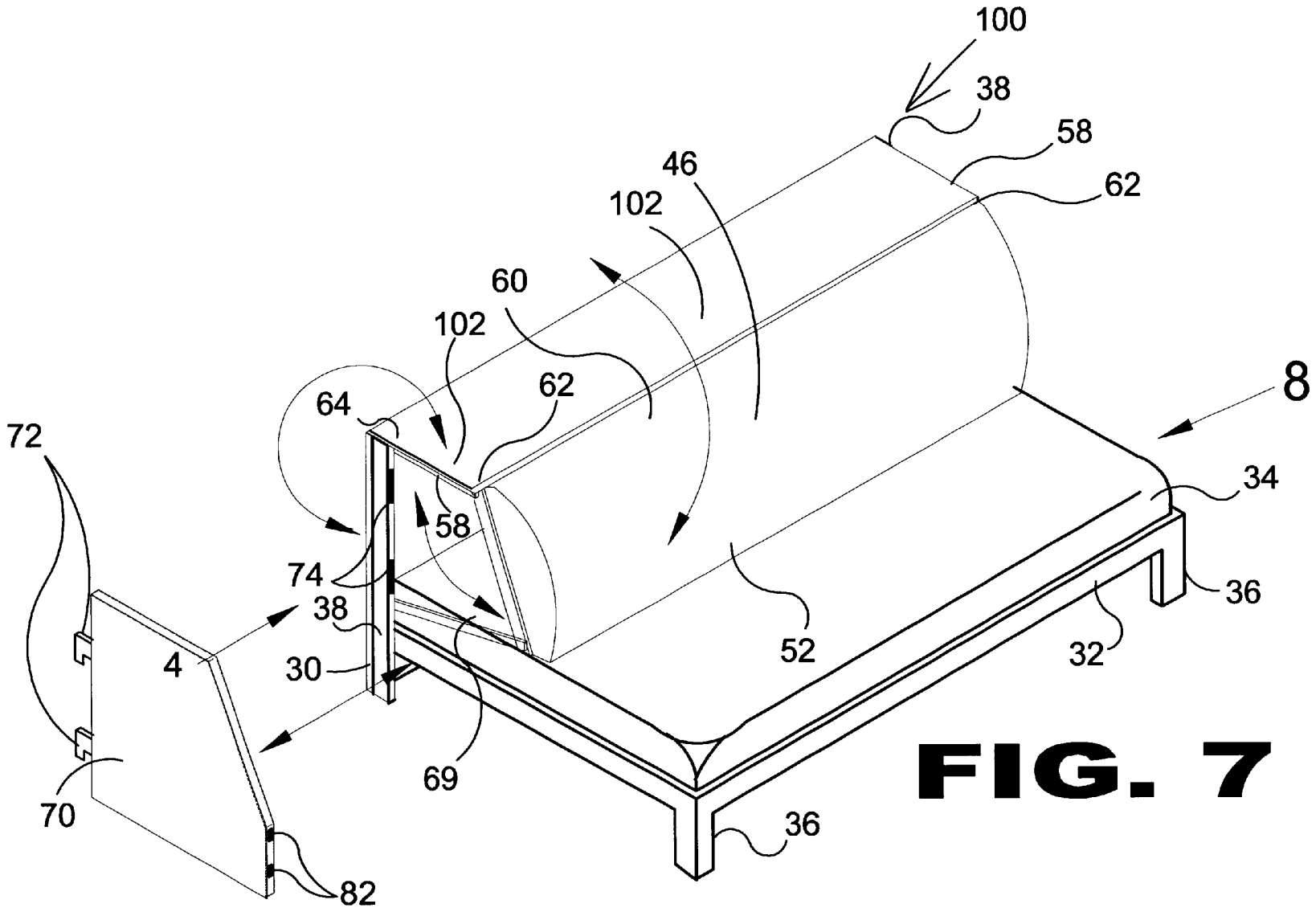

FIG. 7 is a perspective view of an alternate embodiment of the present invention consisting of a lid member that is hinged to the frame back. When in the sofa configuration, the lid member may be used for a shelf. When in the bed configuration position, the top portion may be folded back and out of the way, or lowered to hold bedside accessories or snacks. The side board is separated for this view to show the hooks and hook receptacles by which it is attached.

Figure 8:
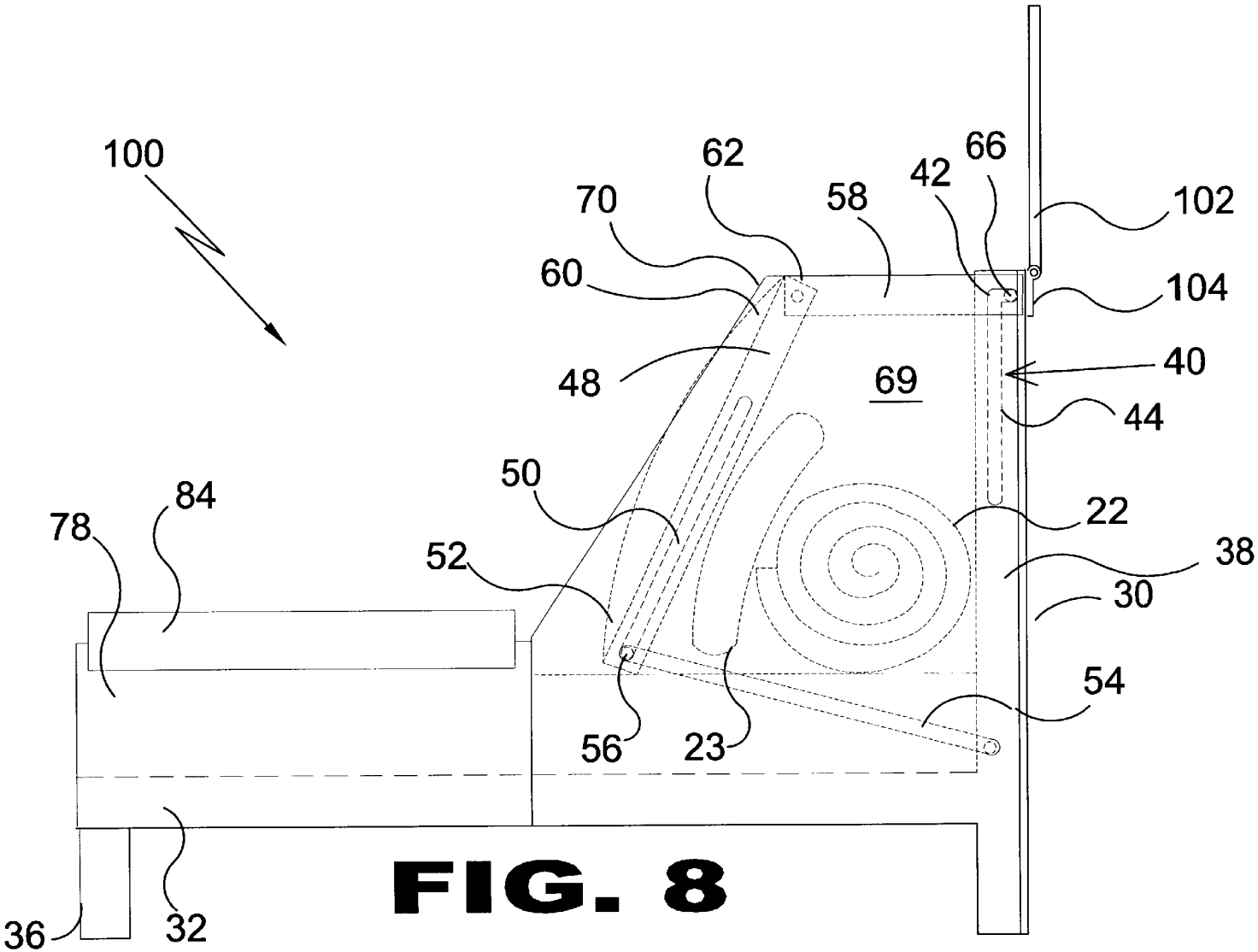

FIG. 8 is a perspective view an alternate embodiment of the present invention consisting of a lid member that is hinged to the frame back. The lid member is shown in the raised position.

Figure 9:
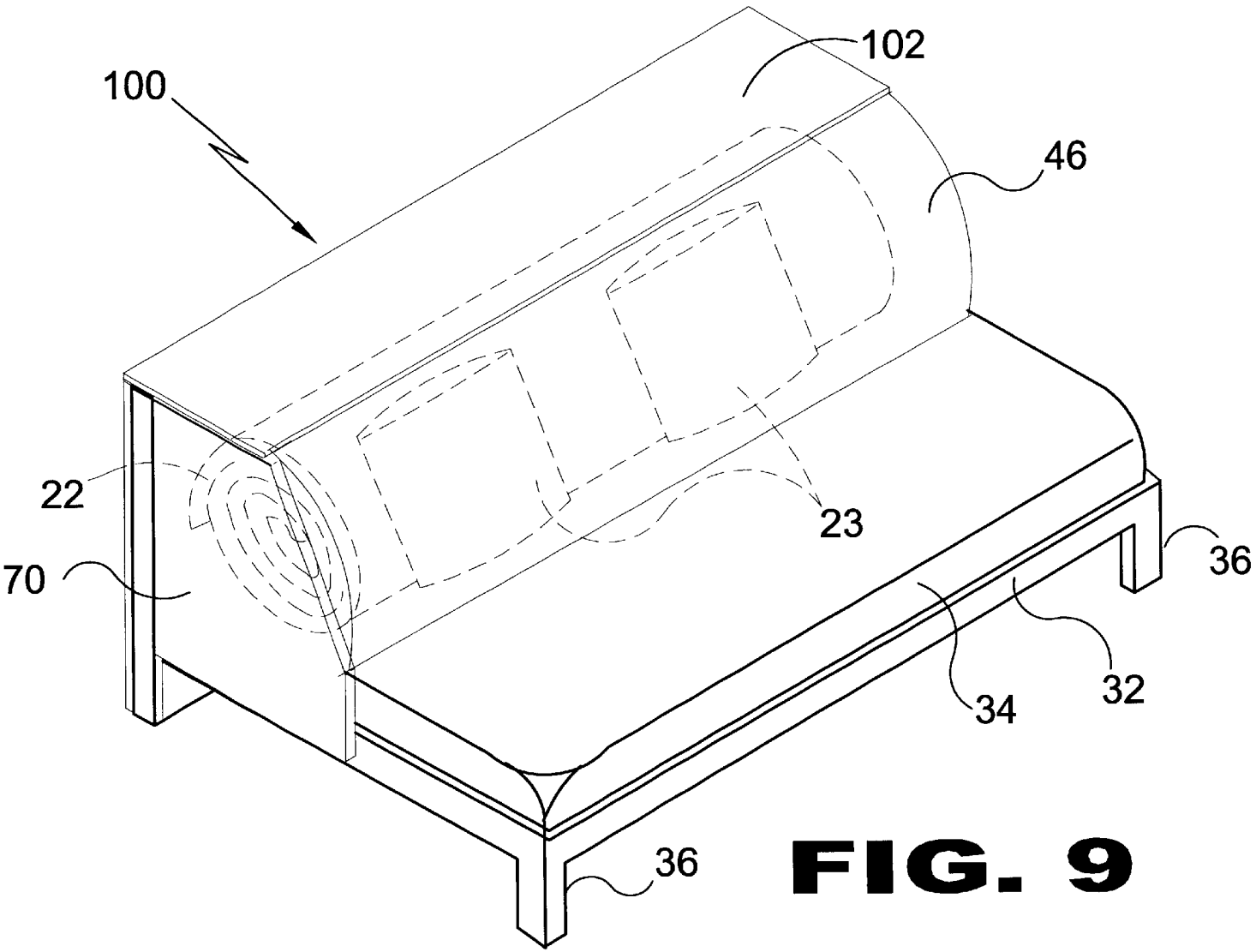

FIG. 9 is a perspective view of an alternate embodiment of the present invention shown in the sofa configuration with mattress rolled or folded and stowed within the containment area, and the hinged lid in the lowered position.

Figure 10:
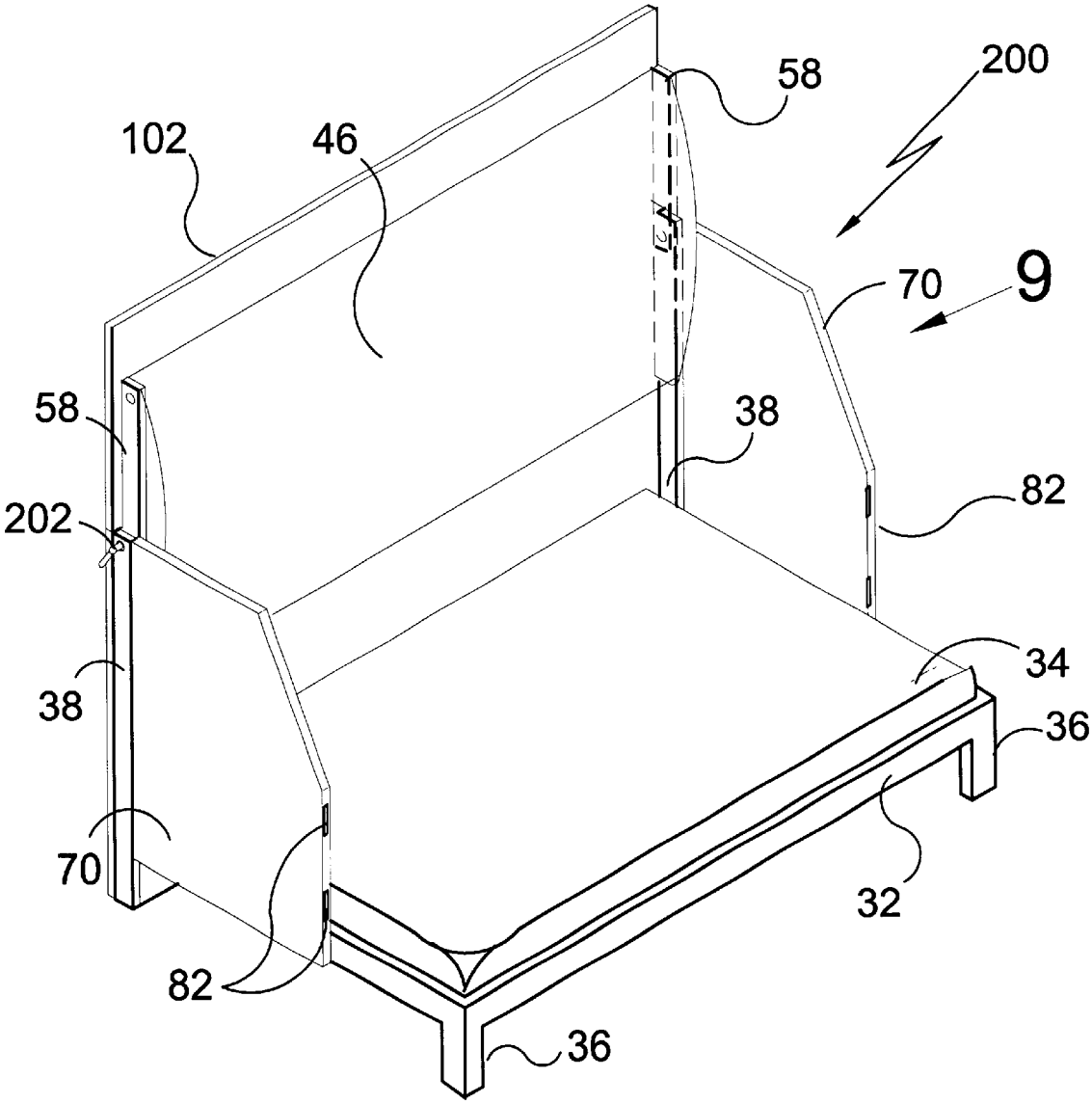

FIG. 10 is a perspective view of an alternate embodiment of the present invention in which the backrest is retained in a suspended position when the sofa bed is in the bed configuration.

DESCRIPTION OF THE REFERENCED NUMERALS

Turning now descriptively to the drawings, in which similar reference characters denote similar elements throughout the several views, the figures illustrate the Sofa Bed of the present invention. With regard to the reference numerals used, the following numbering is used throughout the various drawing figures.

| | |
|---|---|
| 20 | Sofa Bed of the present invention |
| 21 | user |
| 22 | rollup mattress |
| 23 | pillow |
| 24 | sheet |
| 25 | blanket |
| 26 | floor |
| 30 | frame back member |
| 32 | bed portion supporting structure |
| 34 | bed portion |
| 36 | legs |
| 38 | frame post members |
| 40 | "L" slot |
| 42 | "L" slot horizontal portion |
| 44 | "L" slot vertical portion |
| 46 | backrest |
| 48 | backrest framing members |
| 50 | backrest framing member slots |
| 52 | backrest bottom portion |
| 54 | backrest bottom portion positioning members |
| 56 | backrest bottom portion positioning member pins |
| 58 | backrest connection members |
| 60 | backrest top portion |
| 62 | backrest connection member first ends |
| 64 | backrest connection member second ends |
| 66 | backrest connection member second end pins |
| 68 | backrest handle |
| 69 | storage area |
| 70 | side portions |
| 72 | side portion connecting hooks |
| 74 | side portion connecting hook receptacles |
| 76 | lid member |
| 78 | additional removable side portions |
| 80 | additional removable side portion connecting hooks |

-continued

| | |
|---|---|
| 82 | additional removable side portion connecting hook receptacles |
| 84 | armrests |
| 86 | armrest slots |
| 100 | alternate embodiment |
| 102 | lid member |
| 104 | lid member hinge |
| 200 | alternate embodiment |
| 202 | tension knob |

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views, FIGS. 1–10 illustrate the Sofa Bed of the present invention and two alternate embodiments indicated generally by the numerals 20, 100 and 200, respectively.

Figure 1:
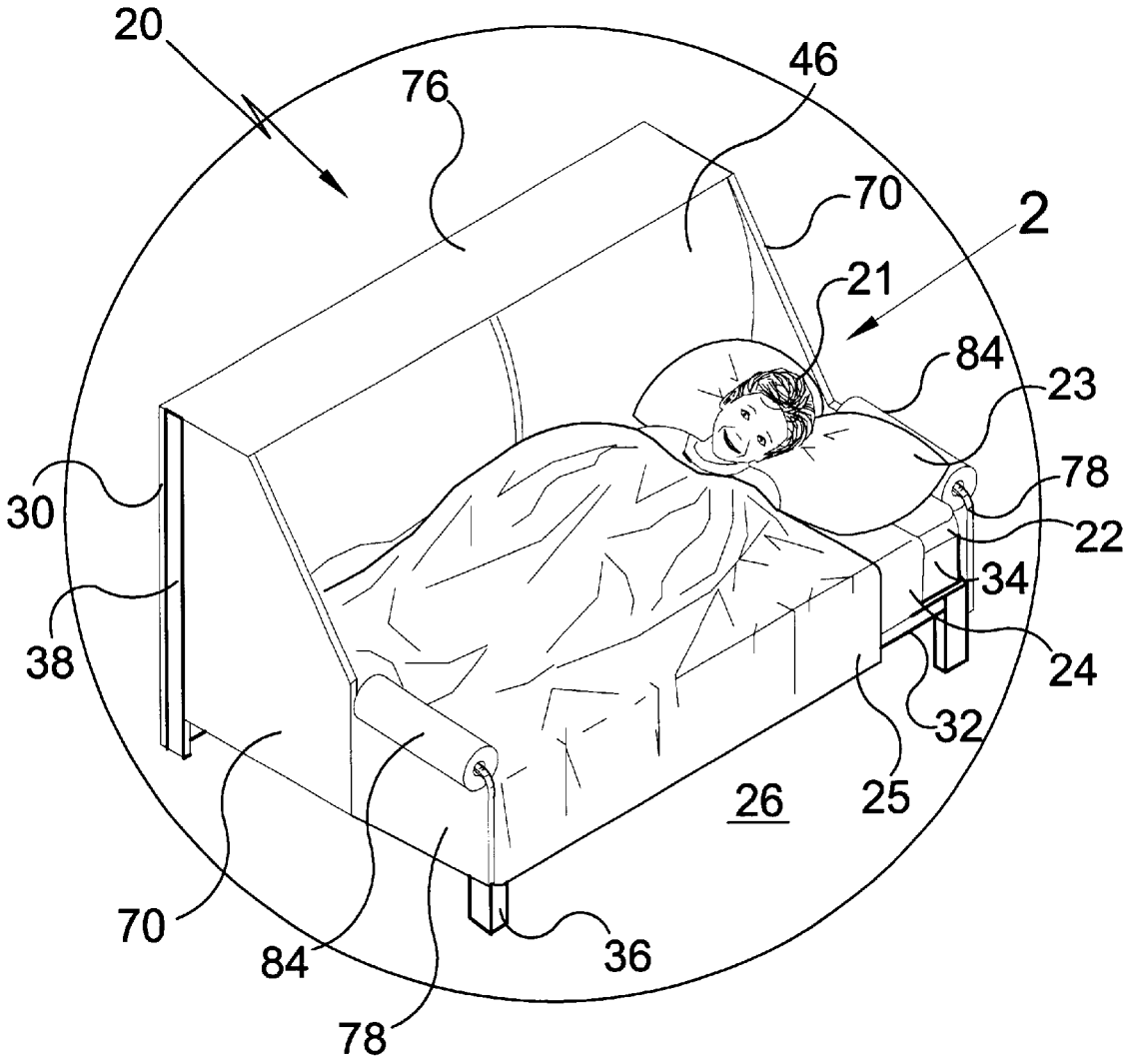
FIG. 1 is a perspective view of the sofa bed of the present invention in the bed configuration.
Figure 2:
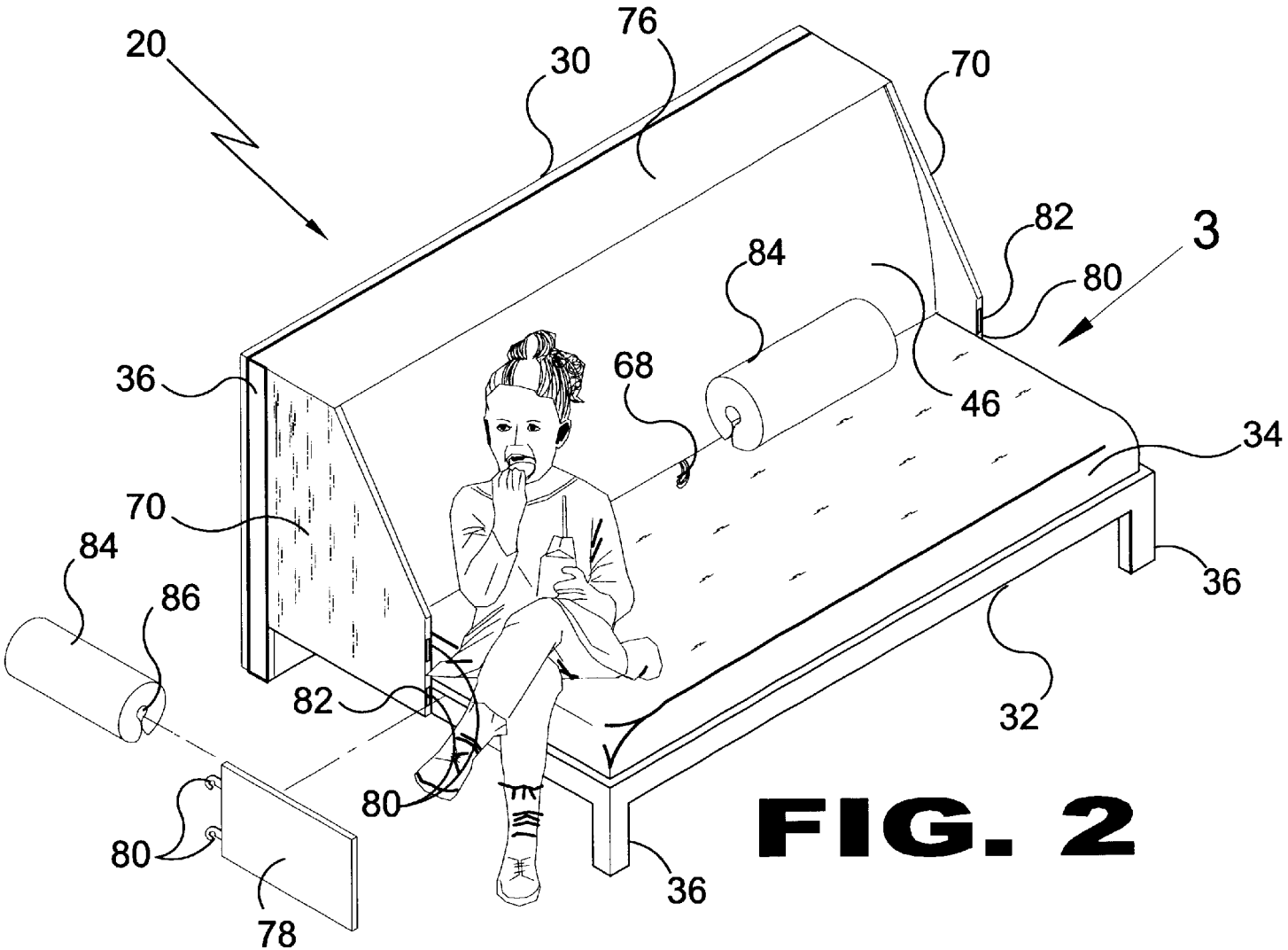
FIG. 2 is a perspective view of the present invention in the sofa configuration. The backrest has been moved forward and braced to create a sofa seat and hidden containment area for bedding storage.

The sofa bed 20 is shown in use by a child 21 in FIGS. 1 and 2, FIG. 1 showing the bed configuration and FIG. 2 showing the sofa configuration. Supplemental bedding items such as a rollup mattress 22, pillow 23, sheet 24 and blanket 25 are depicted in FIG. 1.

The sofa bed 20 includes a frame back member 30 to which is attached a supporting structure 32 for the cushioned horizontal bed portion 34 that serves as both a mattress when in the bed configuration, and as a sofa cushion when in the sofa configuration. In this embodiment the supporting structure 32 partially wraps the supported bed portion 34, and has legs 36 that cooperate with the frame back member 30 to evenly support the bed portion 34. In other embodiments the supporting structure can be box-shaped to the floor 26 and can form a flat surface for the bed portion 34 without wrapping.

Figure 3:
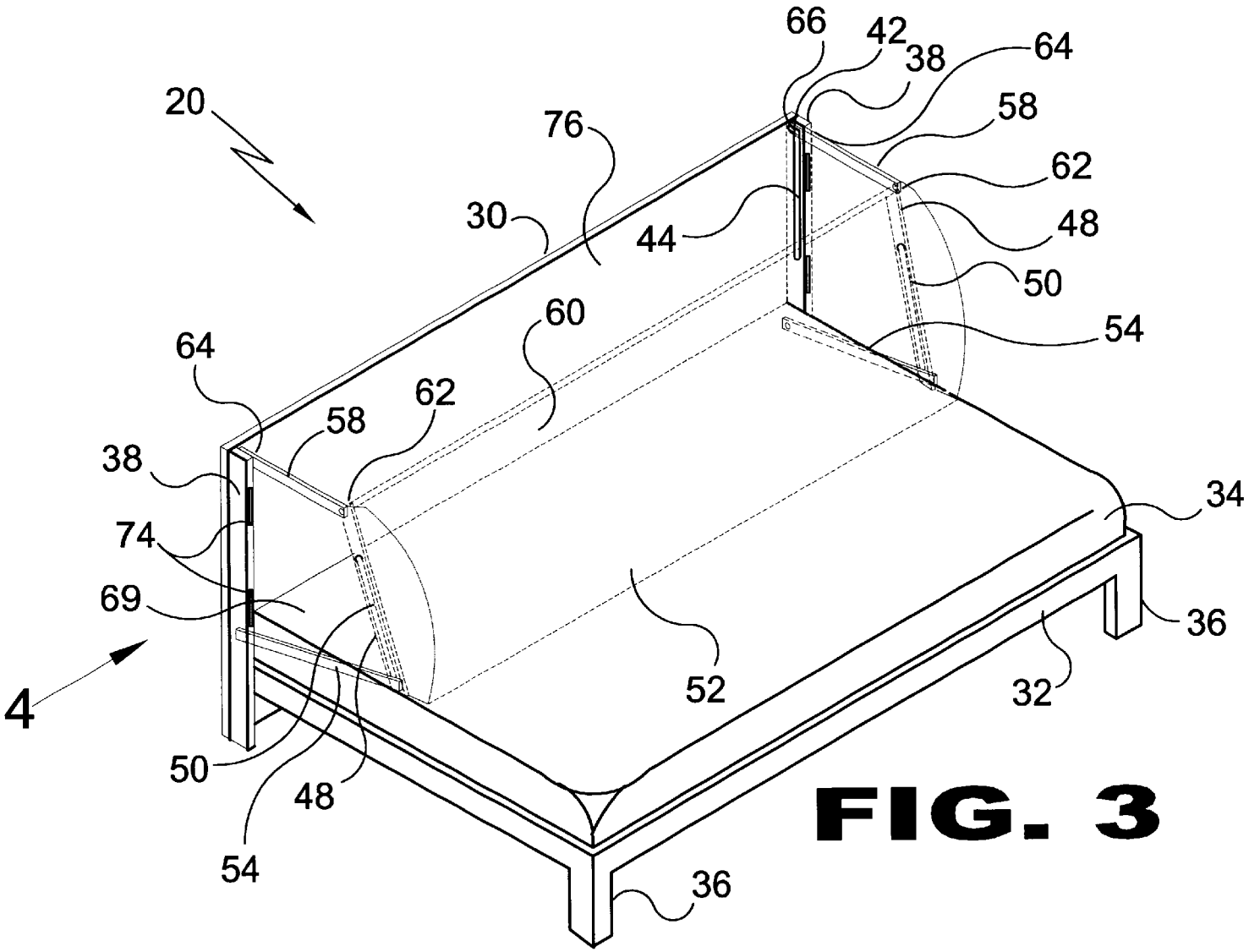
FIG. 3 is a perspective view of the sofa bed of the present invention in the sofa configuration with the backrest connecting and positioning structure shown in hidden line.
Figure 4:
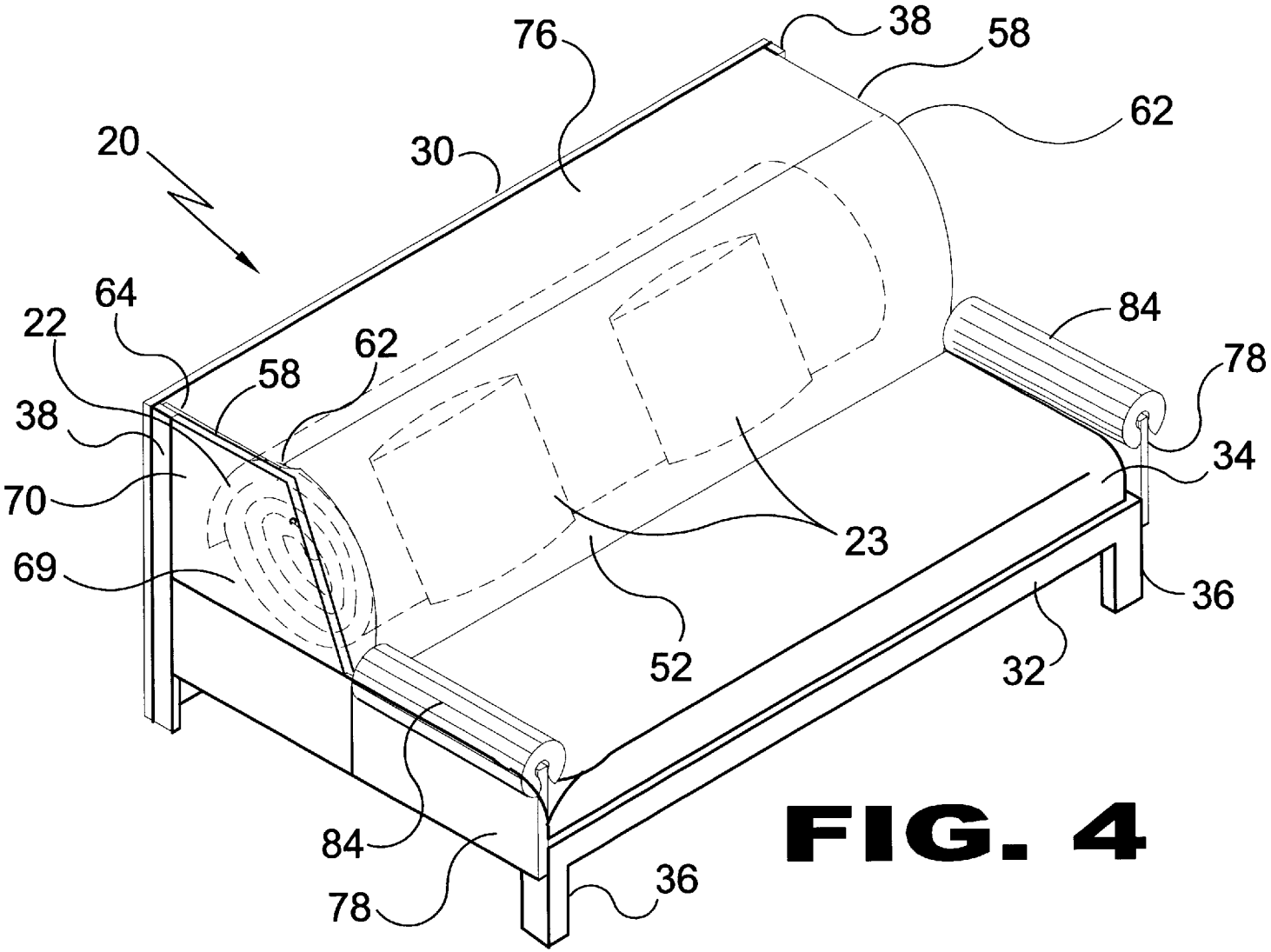
FIG. 4 is a perspective view of the sofa bed of the present invention with the contents of the bedding storage area shown in hidden line.
Figure 5:
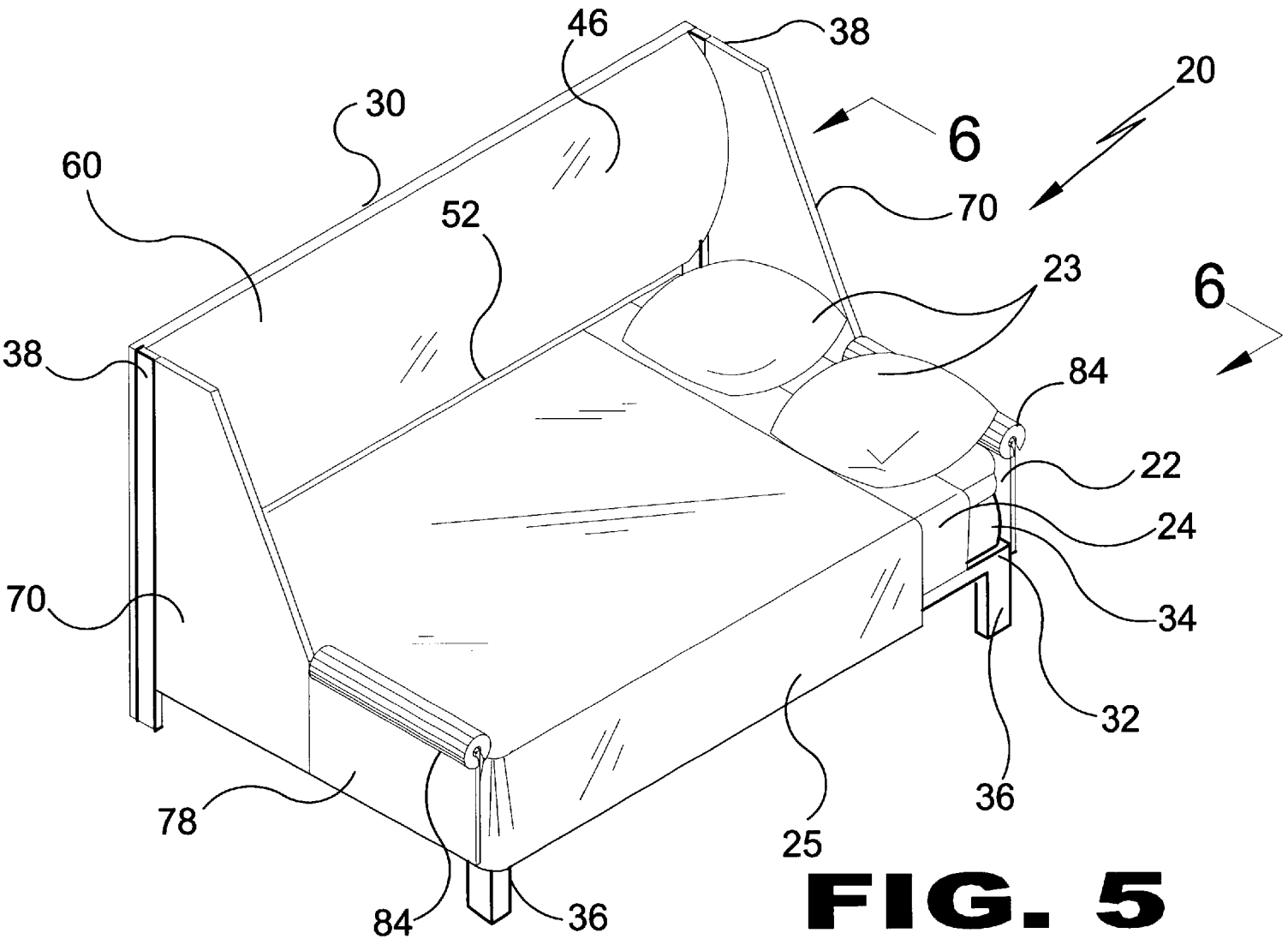
FIG. 5 is a perspective view of the present invention in the bed configuration with bedding materials on the bed portion and the backrest in the rear position.
Figure 6:
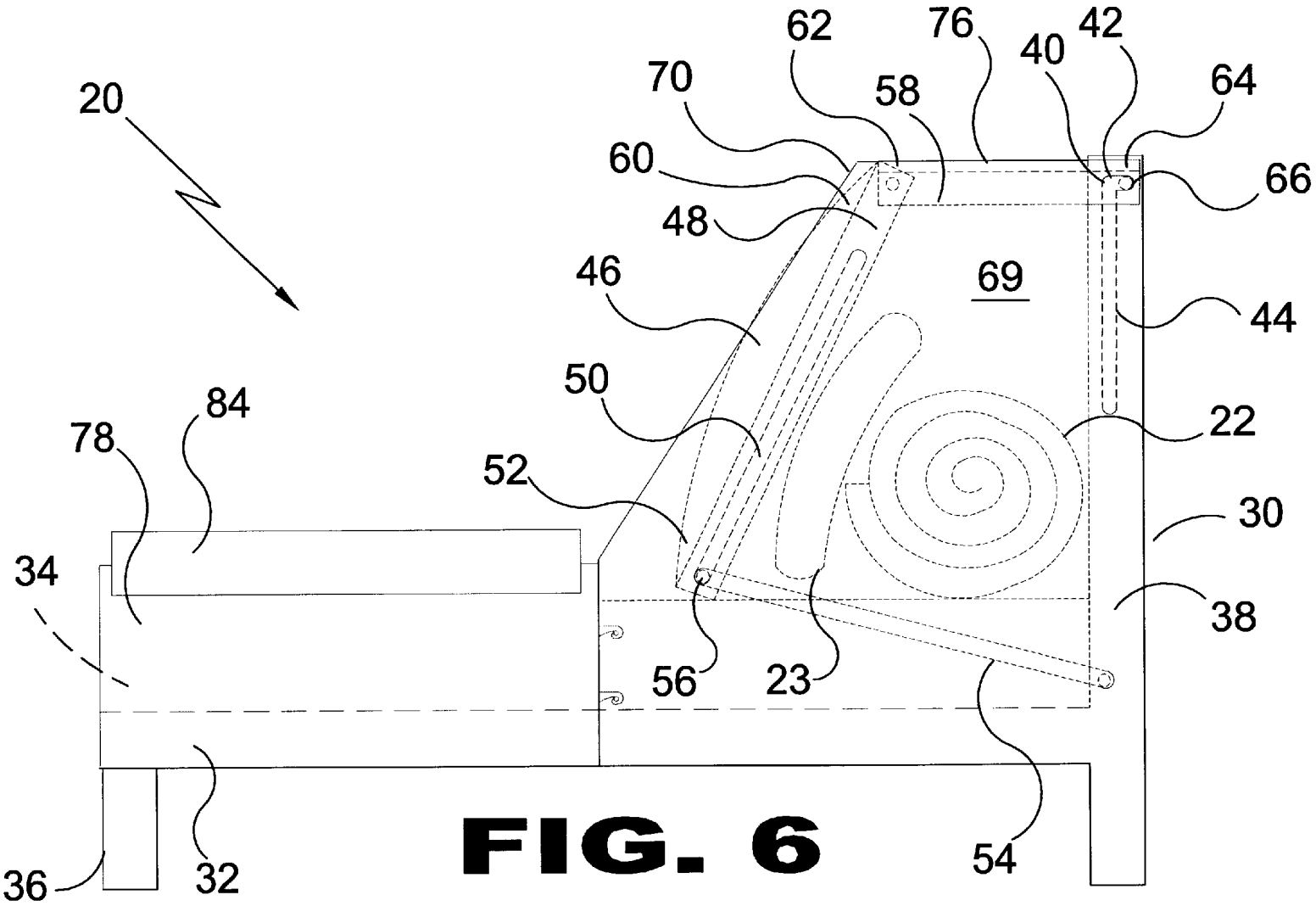
FIG. 6 is a side view of the present invention in the sofa configuration with bedding and pillows stowed out of the way within the storage containment area, as shown in hidden line. Also shown in hidden line is the backrest connecting and bracing structure.

As shown in FIGS. 3 and 4, and particularly in FIG. 6, frame post members 38 are attached to the frame back member 30 and faced in opposition. Each post member has an inverted "L" slot 40, with a short horizontal slot portion 42 and a longer vertical slot portion 44.

A backrest 46 has independent framing and backing, including left and right framing members 48, each framing member having a slot 50. To position the backrest bottom portion 52 in a sofa configuration, i.e. at a distance from the frame back member 30, a pair of elongated and rigid positioning members 54 are each pivotally attached to one of the frame post members 38, and each has a pin 56 that is closely received and secured by one of the framing member slots 50. As a result, the backrest bottom portion 52 is twice braced against the frame post members 38 and will not move rearwardly when a person 21 leans against the backrest 46.

Two connection members 58 are provided to properly position the backrest top portion 60 for the sofa configuration. Each connection member 58 is pivotally attached at its first end 62 to the backrest top portion 60. At the second end 64 of each connection member 58 is a pin 66 that is closely received and secured in one of the frame post member slots 40. As shown in FIG. 6, the pins 66 are placed in the horizontal slot portion 42 thereby securing the connection member second end 64 toward the top of the frame post member 38. As the connection members 58 extend from the frame post members 38 they are held in a generally horizontal position by their attachment to the backrest 46, further pivoting of the backrest 46 on the connection member first end 62, in a downward direction being prevented by the fixed backrest bottom portion 52. The typical loading pattern on a sofa backrest will maintain the pins 66 in the horizontal slot portions 42, thus simultaneously maintaining the backrest 46.

To convert the sofa bed 20 into the bed configuration, the user 21 pulls the backrest top portion 60 in a direction away from the frame back member 30, thus allowing the connection member second end pins 66 to be brought forward in the horizontal slot portions 42 until the pins 66 are positioned for descent into the vertical slot portions 44.

As part of this conversion procedure, the user 21 also lifts the backrest and moves it rearwardly until the connection members 58 are in longitudinal alignment with the vertical slot portions 44. During this movement the backrest bottom portion positioning member pins 56 will be moved along the framing member slots 50, as necessary to allow the connection member pins to descend into the vertical slot portions 44, with the position member pins 56 being moved along the framing member slots 50. When completed the backrest 46 is thus placed in a substantially vertical position near the frame back member 30, with the backrest bottom portion 52 near or on the bed portion 34, a substantial amount of the bed portion 34 being made available for sleeping.

To return to the sofa configuration the backrest 46 is lifted upwardly, outwardly and then briefly rearwardly as necessary to seat the connection member second end pins 66 in the horizontal slot portions 42.

As shown in FIG. 2, a soft, looped handle 69 is attached to the backrest 46 to assist in the movement of the backrest 46 as heretofore described.

In other embodiments the backrest framing member 48 has no slot 50. In these embodiments, one or more of the positioning members 54 braces the backrest bottom portion by being positioned between the backrest bottom portion 52 and the frame back member 30 or frame post member 38. When changing to the sofa bed configuration, the positioning member 54 is removed from the bracing position by detaching either of its ends and moving the detached end against the frame back member 30, when detached from the backrest 46, or against the backrest 46 when detached from the frame back member 30, or frame post member 38.

As shown in FIGS. 4 and 6, the placement of the backrest 46 in the forward position creates significant storage room 69 that is defined and partially enclosed by the frame back member 30 and the backrest 46. To complete the enclosure, side portions 70 are attached permanently, or in this embodiment, by hooks 72 inserted into hook receptacles 74 in the frame post members 38. The side portions 70 can be conformed to the perimeter formed by the frame back member 30 and the backrest 46, or can be re-shaped for other utilitarian or stylistic purposes.

As the final step in completing the enclosure, a lid member 76 extends between and joins the connection members 58. When so joined, the lid member 76 assumes a vertical orientation when the backrest 46 is moved to form the bed configuration.

As shown in FIGS. 2, 4, 5 and 7, additional removable side portions 78 form extensions of the side portions 70, when hooks 80 are inserted into hook receptacles 82 in the side portions 70.

In other embodiments, both the side portions 70 and additional side portions 78 can be permanently attached, integrated to form a single side portion for each end, and/or attached to the bed portion supporting structure 32.

The height of the additional side portions 78 make them ideal for accepting armrest members 84, the armrest members 84 having slots 86, each of which snugly receives one of the additional side portions 78, thus placing the same in ideal position to act as an armrest when the sofa bed 20 is in the sofa configuration, or a pillow when in the bed configuration.

In another embodiment 100, as shown in FIGS. 7–9, the lid member 102 is attached to the frame back member 30 by hinges 104 and is not attached to the connection members 58. In the sofa configuration the lid member 102 is rotated and laid upon the connection members 58 to complete the storage enclosure. In the bed configuration the lid member 102 is lifted and rotated to a vertical position to allow for the movement of the backrest 46 into its rearward position. After the backrest 46 has been so moved, the lid member 102 can be left in the vertical position, or lowered to rest upon side portions 70, then becoming available as a night stand or means to block light from the rearmost occupant.

In another embodiment 200, shown in FIG. 10, the "L" slots 40 are removed from the frame post members 38, and the connection members second end 64 are pivotally attached to the frame post members 38 at a single point. When changing to the bed configuration, the backrest 46 is lifted and swung back in hinge fashion until the connection members 58 are substantially vertical. In this embodiment, the backrest 46 will remain in its suspended and vertical position, thus clearing the bed portion 34 for use. A tension knob 202 is utilized to bear upon the elevated connection member 58 in response to hand-tightening, thus preventing an unintended lowering of the backrest 46.

The sofa bed 20,100,200 and its foregoing components can be constructed using various materials, including various fabrics and cushioning materials for the bed portion 34, backrest 46, armrests 84, lid member 76,102 and other components, while various woods, metals, and plastics can be used for the frame back 30, bed portion supporting structure 32,36, frame post members 38, side boards 60,78, lid members 76,102, and the framing components of the backrest 46. The materials, in various component combinations, can be sized to accommodate users of various sizes, all in accordance with the present invention, and as determined by the intended end use for the overall device.

With respect to the above description then, it is to be realized that the optimum material and dimensional relationships for the parts of the sofa bed 20,100,200, to include variations in size, materials, shape, and form, will occur to those skilled in the art upon review of the present disclosure, and all equivalent relationships to those illustrated in the drawings and described in the specification are intended to be encompassed by the present invention.

What is claimed as new and desired to be protected by Letters Patent is set forth in the appended claims:

1. A sofa bed that is selectably convertible between a bed and sofa on a horizontal surface, comprising:

a substantially horizontal bed member;

a frame, the frame having:

a substantially vertical back member; and a supporting structure for the bed member; and a first and second post member attached to the frame back member, each post member having a slot, the slot having a substantially horizontal slot portion and a connected, substantially vertical slot portion;

a backrest having a top portion and a bottom portion;

a first and second backrest connection member, each connection member having a first end, the first end being pivotally connected to the backrest, each connection member also having a second end, each second end having a pin, the first backrest connection member second end pin being received by the first post member slot, the second backrest connection member second end pin being received by the second post member slot, said pins being movable within and along the horizontal slot portions into the vertical slot portions, such that the backrest top portion is positioned near the frame back member when the second end pins are in the vertical slot portions, and the backrest top portion is positioned at a distance from the frame back member when the second end pins are in the horizontal slot portions; and a backrest bottom portion positioning member, the positioning member positioning the backrest bottom at a distance from the frame back member when the backrest top portion is positioned at a distance from the frame back member.

2. The sofa bed of claim 1, wherein the frame back member has a top portion and wherein the sofa bed further comprises a lid member, the lid member extending from the first backrest connection member to the second backrest connection member, the lid member extending from proximate the backrest top portion to proximate the frame back member top portion.

3. The sofa bed of claim 2, wherein the lid member is constructed from a fabric.

4. The sofa bed of claim 1, wherein the frame back member has a top portion and wherein the sofa bed further comprises a lid member, the lid member being pivotally connected to the frame back member top portion and, in a first position, extending from proximate the backrest top portion to proximate the frame back member top portion, and in a second position, extending upwardly from the frame back member.

5. The sofa bed of claim 4, wherein the sofa bed further comprises at least one hand-tightenable tension grip assembly having a pressure member, the at least one grip assembly pressure member being positioned to apply pressure, in response to hand-tightening of the grip assembly, to the connection member, thereby retarding movement of the connection member.

6. The sofa bed of claim 1, wherein the sofa bed further comprises at least one side portion attached to the frame.

7. The sofa bed of claim 6, wherein the at least one side portion extends to the backrest when the backrest is positioned at a distance from the frame back member, forming an interior walled by the side portion, the backrest and the frame back member.

8. The sofa bed of claim 6, wherein the sofa bed further comprises at least one removable side portion, adapted for attachment to the at least one side portion.

9. The sofa bed of claim 8, wherein the number of side portions is two.

10. The sofa bed of claim 9, wherein the number of removable side portions is two.

11. The sofa bed of claim 8, wherein the sofa bed further comprises at least one armrest member, each armrest member having a slot, the slot being adapted to closely receive the removable side portion.

12. The sofa bed of claim 11, wherein each of the at least one armrest members is cushioned.

13. The sofa bed of claim 6, wherein the at least one side portion is removably attached to the frame.

14. The sofa bed of claim 13, wherein the at least one side portion is fastened to one of the frame post members using at least one hook fastener.

15. The sofa bed of claim 6, wherein the sofa bed further comprises at least one armrest member, each armrest member being adapted for attachment to the horizontal bed portion supporting structure.

16. The sofa bed of claim 15, wherein each of the at least one armrest members is cushioned.

17. The sofa bed of claim 6, wherein the number of side portions is two.

18. The sofa bed of claim 1, wherein the backrest further comprises at least one framing member and the backrest positioning member further comprises at least one elongated member, the at least one elongated member having a first end and a second end, the at least one first end being attached to the backrest, the at least one second end being attached to the frame such that the backrest bottom portion is braced against movement toward the frame back member.

19. The sofa bed of claim 18, wherein the at least one first end attachment to the backrest is detachable and reattachable.

20. The sofa bed of claim 18, wherein the at least one second end attachment to the frame is detachable and reattachable.

21. The sofa bed of claim 18, wherein the at least one second end is attached to one of the frame post members.

22. The sofa bed of claim 18, wherein the at least one second end is attached to the frame back member.

23. The sofa bed of claim 1, wherein the backrest is cushioned.

24. The sofa bed of claim 1, wherein the frame horizontal bed portion is cushioned.

25. The sofa bed of claim 1, wherein the frame horizontal bed portion is removable from the supporting structure.

26. The sofa bed of claim 1, wherein the backrest further comprises a left and right framing member, each framing member having a slot, and the backrest positioning member further comprises a left and right elongated member, each elongated member having a first end, each of the first ends having a pin, each of the pins positioned in one of the framing member slots, each elongated member having a second end, each second end being pivotally connected to one of the post members, the framing member slots being of sufficient length to allow the backrest connection member second end pins to move through the length of the vertical slot portions in the post members.

* * * * *